US009340920B2

(12) United States Patent
Hawley et al.

(10) Patent No.: US 9,340,920 B2
(45) Date of Patent: May 17, 2016

(54) HANDICRAFT TOOL FOR PRESSING OR SUPPORTING CLOTH OR FABRIC

(71) Applicant: CLOVER MFG. CO., LTD., Osaka-shi, Osaka (JP)

(72) Inventors: Joan Hawley, Westerville, OH (US); Chihiro Iwasaki, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 72 days.

(21) Appl. No.: 14/056,413

(22) Filed: Oct. 17, 2013

(65) Prior Publication Data

US 2015/0108181 A1 Apr. 23, 2015

(51) Int. Cl.
*D06F 85/00* (2006.01)
*D06F 71/30* (2006.01)
*D06F 81/10* (2006.01)

(52) U.S. Cl.
CPC ..... *D06F 85/00* (2013.01); *D06F 71/30* (2013.01); *D06F 81/10* (2013.01)

(58) Field of Classification Search
CPC ..... D06F 71/16; D06F 71/18; D06F 7/22; D06F 7/30; D06F 7/36; D06F 7/40; D06F 85/00; D06F 81/10; D06F 81/12; A41H 33/00
USPC ..... D28/57, 62; D32/66
See application file for complete search history.

(56) References Cited

U.S. PATENT DOCUMENTS 414,090 A * 10/1889 Taylor ..... B21C 3/06 112/222
1,269,205 A * 6/1918 Neff ..... D06J 1/00 2/138
1,413,033 A * 4/1922 Keyser ..... 132/75.3
1,715,914 A * 6/1929 Halk ..... 132/73
2,035,323 A * 3/1936 Langdon ..... 132/75.3
2,097,521 A * 11/1937 Haas ..... D06F 81/12 219/228
2,556,815 A * 6/1951 Lovelace ..... 38/141
2,561,764 A * 7/1951 Wattles ..... 223/57
2,764,989 A * 10/1956 Simmons ..... 132/75.3
3,482,744 A * 12/1969 Schlemon ..... D06F 59/02 223/63
3,726,449 A * 4/1973 Kern ..... D06J 1/00 223/35
3,916,546 A * 11/1975 Bullock ..... D06F 81/00 38/1 B
4,427,139 A * 1/1984 Depriest ..... 223/2
4,674,780 A * 6/1987 Weinerman ..... E05B 85/08 292/1
4,770,195 A * 9/1988 Dore ..... 132/73
5,782,154 A * 7/1998 Hansen ..... 83/167
6,059,095 A * 5/2000 Tsuji ..... B65G 39/02 193/35 F
2008/0111113 A1* 5/2008 Mizumoto ..... C08J 9/0066 252/519.5

OTHER PUBLICATIONS

The Complete Book of Sewing Short Cuts, Claire B. Shaeffer, Sterling Publishing Co., 1981, p. 13.*

* cited by examiner

*Primary Examiner* — Ismael Izaguirre
(74) *Attorney, Agent, or Firm* — Hamre, Schumann, Mueller & Larson, P.C.

(57) ABSTRACT

A handicraft tool includes a first end, a second end and an intermediate portion. The first end and the second end are spaced apart from each other in the longitudinal direction of the handicraft tool. The intermediate portion is positioned between the first end and the second end. The intermediate portion is in the form of a bar having a cross section that is uniform along the longitudinal direction. At least the surface of the intermediate portion is made of a thermosetting elastomer.

9 Claims, 9 Drawing Sheets

HANDICRAFT TOOL FOR PRESSING OR SUPPORTING CLOTH OR FABRIC

BACKGROUND OF THE INVENTION

1. Field of the Invention

The present invention relates to a handicraft tool used for pressing or supporting cloth or fabric. The handicraft tool of the present invention is used, for example, as a supporting base for cloth to be ironed.

2. Description of the Related Art

As a conventional ironing technique, the so-called "seam allowance opening" method is known. This ironing method may be performed as follows. (1) Two pieces of cloth are sewed together in a manner such that each piece has a predetermined seam allowance. (2) The sewed cloth pieces are opened flat on an ironing board, with the seam allowances located on the upper side. (3) The seam allowances are folded back onto the opposite sides, respectively, with the seam extending between them. (4) The opened seam allowances are pressed with an iron to form a crease.

In the above-described seam allowance opening, a conventional ironing board is used for performing the ironing. In this case, however, traces of the seam allowances may appear on the obverse side of the cloth. In particular, when the cloth is thick, the trace of the seam allowance tends to be too conspicuous, which is not desirable in terms of appearance.

SUMMARY OF THE INVENTION

The present invention has been conceived under the circumstances described above. It is therefore an object of the present invention to provide a handicraft tool that can dissolve or alleviate the above-described problem and is suitably used in ironing.

A handicraft tool provided according to the present invention includes a first end and a second end spaced apart from each other in a longitudinal direction, and an intermediate portion positioned between the first end and the second end. The intermediate portion is in the form of a bar having a cross section that is uniform along the longitudinal direction. At least a surface of the intermediate portion is made of a thermosetting elastomer.

Preferably, the intermediate portion is columnar.

Preferably, the first end includes a first flat surface and a second flat surface that face away from each other in a direction perpendicular to the longitudinal direction. The first flat surface and the second flat surface come closer to each other as proceeding toward the tip of the first end.

Preferably, the outer circumference of the first end in a predetermined region elongated in the longitudinal direction is substantially equal to the outer circumference of the intermediate portion.

Preferably, the second end has a round tip.

Preferably, the handicraft tool according to the present invention further includes a shaft member elongated in the longitudinal direction and made of a metal. The shaft member is embedded at least in the intermediate portion.

Other features and advantages of the present invention will become more apparent from detailed description given below with reference to the accompanying drawings.

DESCRIPTION OF THE PREFERRED EMBODIMENTS

Preferred embodiments of the present invention are described below with reference to the accompanying drawings.

Figure 1:
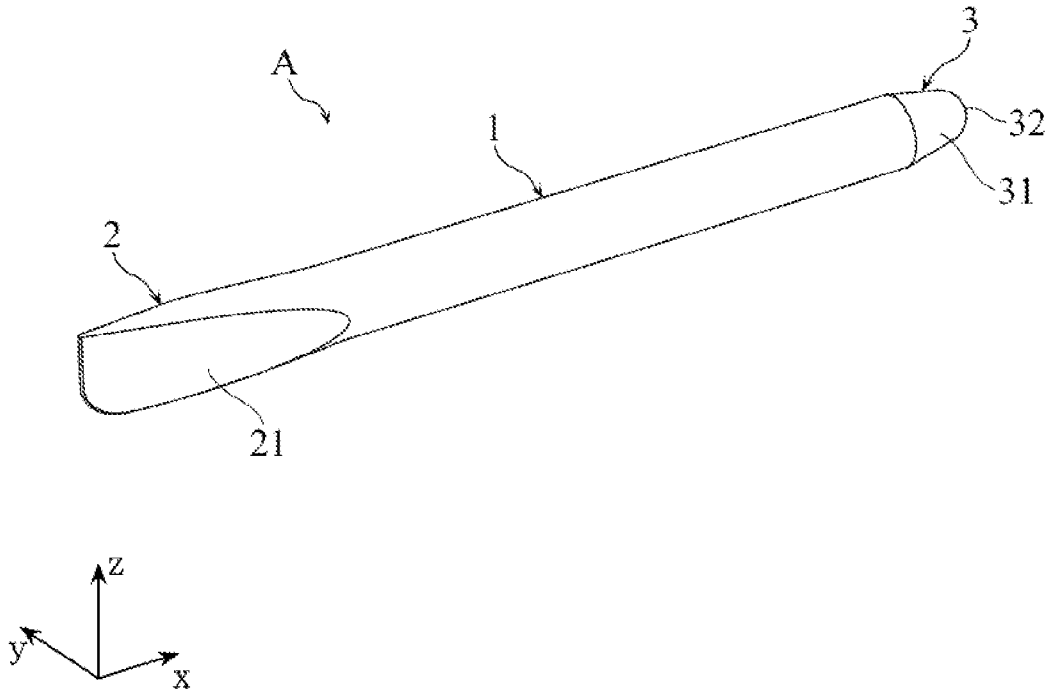
FIG. 1 is a perspective view of a handicraft tool according to an embodiment of the present invention.
Figure 2:
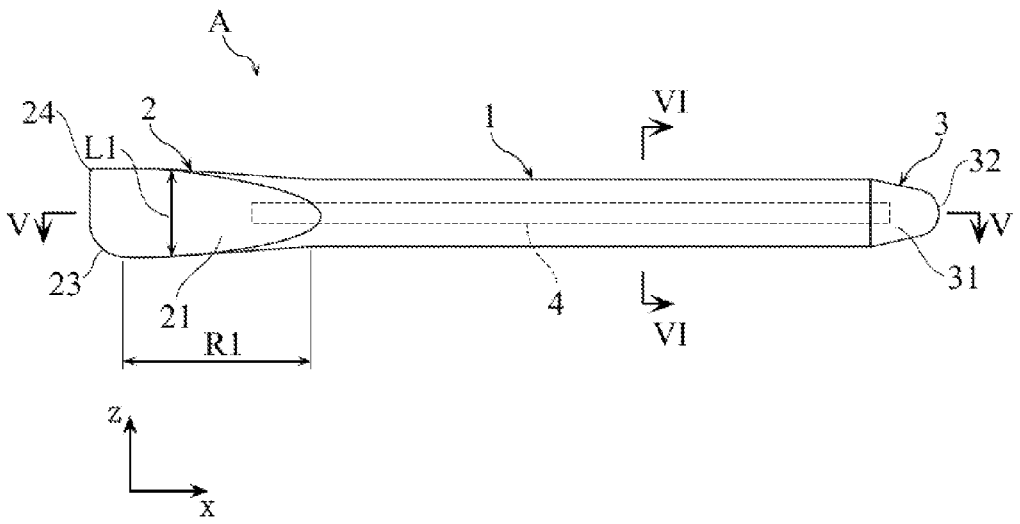
FIG. 2 is a front view of the handicraft tool shown in FIG. 1.
Figure 3:
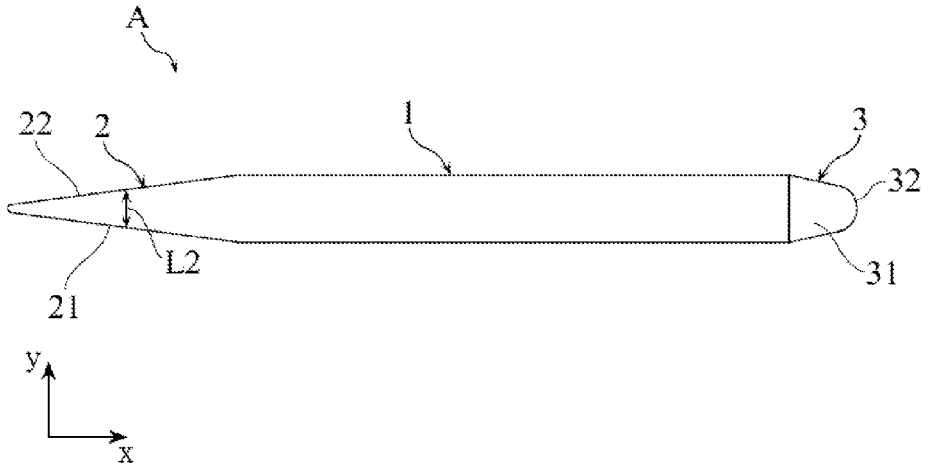
FIG. 3 is a plan view of the handicraft tool shown in FIG. 1.
Figure 4:
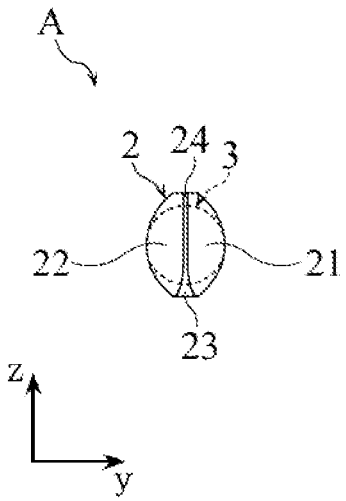
FIG. 4 is a left side view of the handicraft tool shown in FIG. 1.

FIGS. 1-6 show a handicraft tool according to an embodiment of the present invention. As shown in FIGS. 1-3, the handicraft tool A of this embodiment is in the form of a bar extending straight as a whole. The handicraft tool A includes a first end 2 and a second end 3 spaced apart from each other in the longitudinal direction x, and an intermediate portion 1 positioned between the first end 2 and the second end 3.

The intermediate portion 1 has a substantially constant outer diameter and has a columnar shape elongated in the longitudinal direction x. For instance, the intermediate portion 1 is about 20 mm in outer diameter and about 160 mm in length in the longitudinal direction x. For instance, the intermediate portion 1 is used in ironing to open the seam allowances, as described later. At least the surface of the intermediate portion 1 is made of a thermosetting elastomer. As indicated by the dashed line in FIG. 2, a shaft member 4 is embedded in the intermediate portion 1. In the illustrated example, the shaft member 4 has a left end extending into a part of the first end 2 of the handicraft tool A and a right end extending into a part of the second end 3 of the handicraft tool A.

As shown in FIGS. 1-3, the first end 2 is connected to the intermediate portion 1 and has a first flat surface 21 and a second flat surface 22. The first flat surface 21 and the second flat surface 22 face away from each other in the direction y perpendicular to the longitudinal direction x of the handicraft tool A. The first flat surface 21 and the second flat surface 22 are inclined so as to come closer to each other as proceeding toward the tip of the first end 2.

As shown in FIG. 2 (i.e., as viewed in the direction y), the dimension L1 of the first end 2 in the direction z perpendicular to the longitudinal direction x increases as proceeding toward the tip of the first end 2. On the other hand, as shown in FIG.

3, the dimension L2 of the first end 2 (i.e., the dimension in the direction y) reduces as proceeding toward the tip of the first end 2.

In a predetermined region of the first end 2 excluding the tip (i.e., the region indicated by the reference sign R1 in FIG. 2), the outer circumference of the first end 2 (i.e., length of the circumference of the cross section perpendicular to the longitudinal direction x) is substantially constant at each point in the longitudinal direction x, and this constant circumference is substantially equal to the outer circumference of the intermediate portion 1. In this embodiment, as shown in FIG. 2, the lower side (one side in the direction z) of the tip of the first end 2 is provided with an arcuately curved portion 23, whereas the upper side (the other side in the direction z) of the tip of the first end 2 is provided with a sharp corner 24.

The second end 3 is connected to the intermediate portion 1 and includes a conical tapered portion 31 that reduces its diameter as proceeding toward the tip and a spherical portion 32 positioned at the tip. The spherical portion 32 is a round portion and has a diameter (radius of curvature×2) smaller than the outer diameter of the intermediate portion 1.

Figure 5:
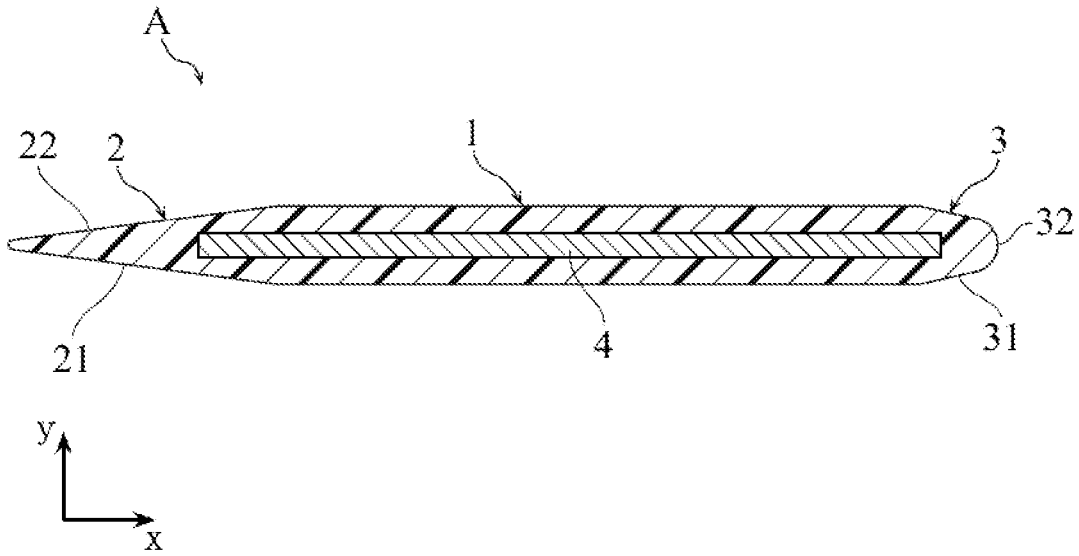
FIG. 5 is a sectional view taken along lines V-V in FIG. 2.
Figure 6:
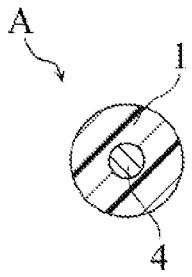
FIG. 6 is a sectional view taken along lines VI-VI in FIG. 2.
Figure 7:
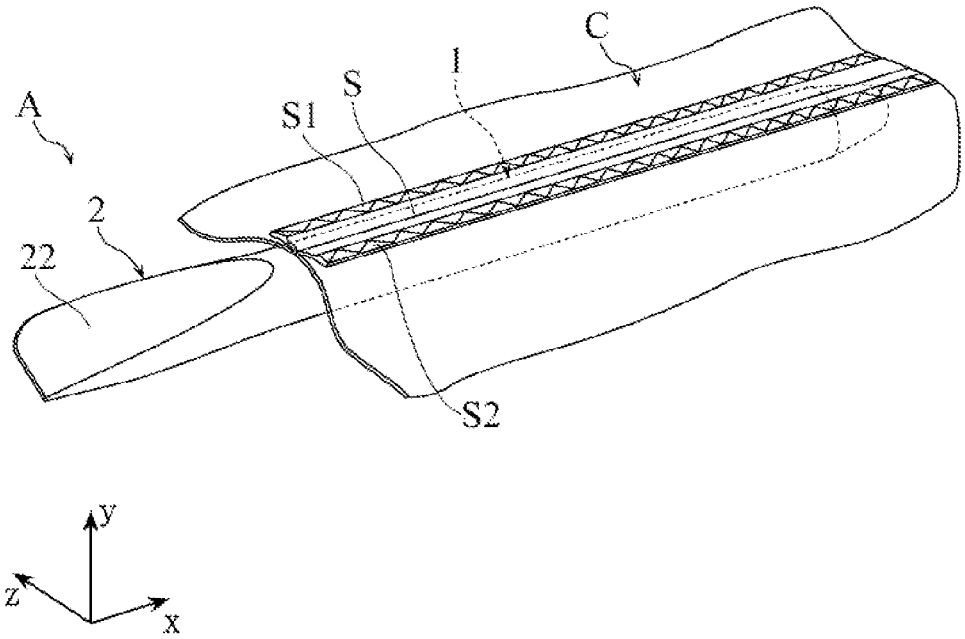
FIG. 7 is a perspective view for describing a use of the handicraft tool.

As shown in FIGS. 2 and 5, the shaft member 4 is elongated in the longitudinal direction x of the handicraft tool A. The shaft member 4 is embedded to extend over the intermediate portion 1, and further into a part of the first end 2 and a part of the second end 3, both of which are connected to the intermediate portion 1. The shaft member 4 is a round metal rod (see FIG. 6) made of e.g. stainless steel.

In this embodiment, the intermediate portion 1, the first end 2 and the second end 3 are made as one piece from a thermosetting elastomer. Generally, thermosetting elastomer has excellent thermal resistance and is resilient. Examples of thermosetting elastomer include silicone rubber, urethane rubber and fluorocarbon rubber, but thermosetting elastomer is not limited to these. The handicraft tool A with the shaft member 4 embedded in it can be formed by e.g. insert molding.

The use and advantages of the handicraft tool A are described below with reference to FIGS. 7-12.

For instance, the handicraft tool A can be used in ironing seam allowances. First, the cloth C is placed on the handicraft tool A (intermediate portion 1), with the seam allowances of the cloth C on the upper side. In this process, the cloth is placed in such a manner that the seam S extends along the generatrix of the circumferential side surface of the intermediate portion 1. Then, the seam allowances S1 and S2 are opened to the opposite sides to sandwich the seam S (see FIG. 7) and pressed with an iron so that a sharp crease is formed.

Figure 8:
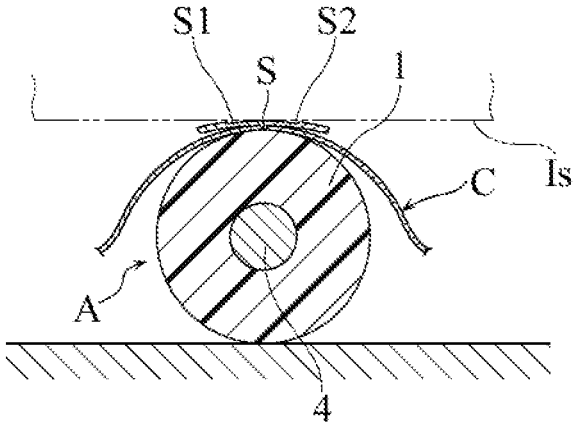
FIG. 8 is a sectional view for describing the use of the handicraft tool.

Since the intermediate portion 1 of the handicraft tool A is columnar, only the portions of the seam allowances S1 and S2, which are relatively close to the seam S, are pressed by the flat ironing surface Is, as shown in FIG. 8. The portions of the seam allowances S1 and S2 which are distant from the seam S are not pressed by the ironing surface Is. As will be understood from this, by using the handicraft tool A (intermediate portion 1) in ironing, traces of the seam allowances S1, S2 are prevented from being formed in the cloth C, so that the ironed cloth C has a good finish.

The surface of the intermediate portion 1 is made of thermosetting elastomer. Thus, the intermediate portion 1 is not deformed by the heat from the iron during the ironing. Further, the cloth C is not damaged by the intermediate portion (handicraft tool A).

The thermosetting elastomer has a relatively high frictional resistance against an external object in contact. Thus, in performing ironing using the handicraft tool A, the cloth C does not move relative to the intermediate portion 1, so that ironing is performed easily.

Figure 9:
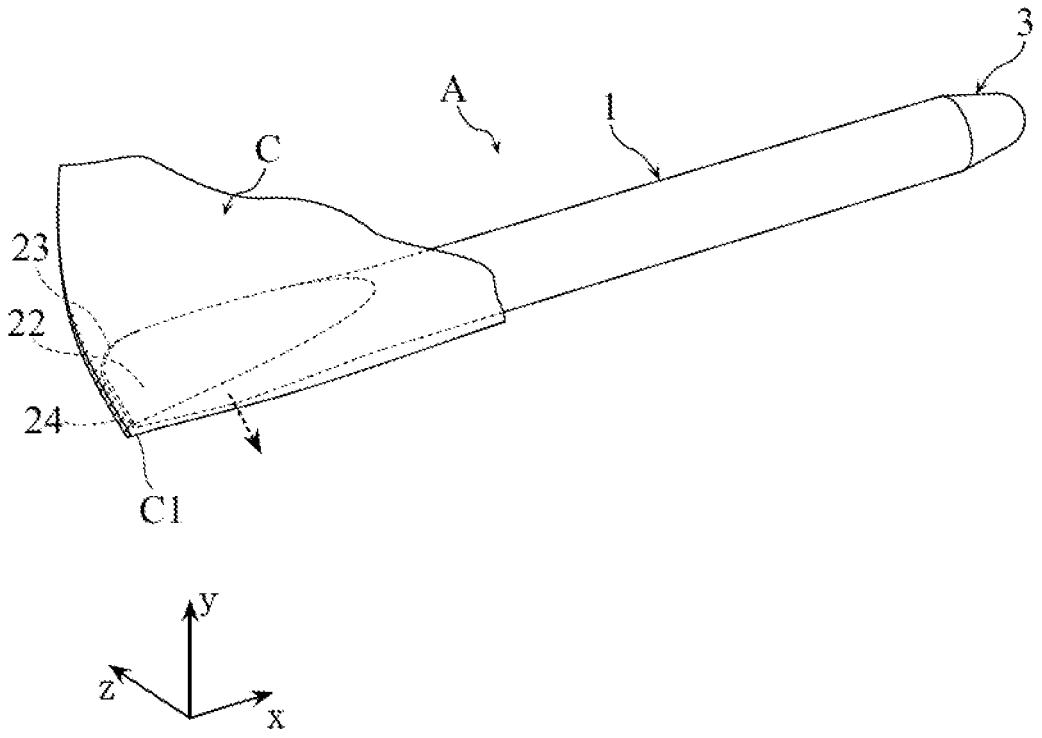
FIG. 9 is a perspective view for describing another use of the handicraft tool.

The first end 2 has a first flat surface 21 and a second flat surface 22 which come closer to each other as proceeding toward the tip of the first end 2. That is, the tip of the first end 2 has a wedge shape. With this arrangement, as shown in FIG. 9, the first end 2 can be easily inserted into e.g. bag-shaped cloth C. By pushing the corner C1 of the bag-shaped cloth C with the sharp corner 24 of the first end 2, the corner C1 is shaped properly. In the case of bag-shaped cloth having a round corner, the round corner of the cloth is pushed with the curved corner 23 of the tip of the first end 2, whereby the corner of the cloth is shaped properly.

Figure 10:
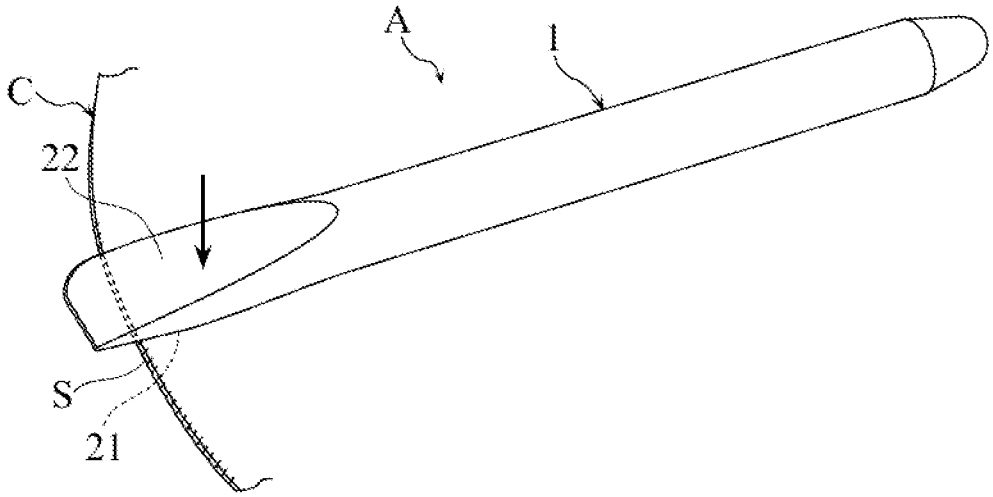
FIG. 10 is a perspective view for describing another use of the handicraft tool.
Figure 11:
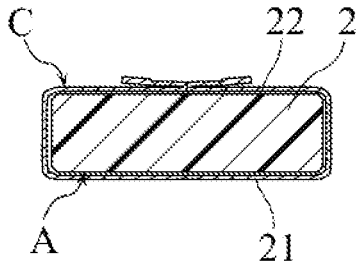
FIG. 11 is a sectional view showing a first end for describing a use of the handicraft tool.

As shown in FIG. 10, the seam S of the cloth C can be pressed over a predetermined range with the first flat surface 21 (or the second flat surface 22) so that the shape of the seam S is adjusted. Since the shaft member 4 is embedded in the intermediate portion 1, even when the intermediate portion 1 is held and pressed against the cloth C (i.e., a relatively large bending load is applied to the intermediate portion 1), problems such as bending of the intermediate portion 1 do not occur.

Figure 12:
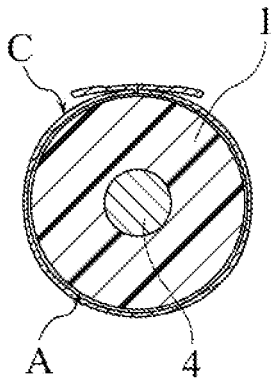
FIG. 12 is a sectional view showing an intermediate portion for describing a use of the handicraft tool.

In the predetermined region R1 elongated in the longitudinal direction x, the outer circumference of the first end 2 is substantially constant and equal to the outer circumference of the intermediate portion 1. Such an arrangement is advantageous in using the handicraft tool A for ironing the cloth C sewed into a tubular shape. Specifically, for the ironing, the handicraft tool A need be inserted into the tube of the cloth C. As understood from FIGS. 11 and 12, if the first end 2 can be inserted into and passed through the tube of the cloth C (FIG. 11), the intermediate portion 1 can also be passed through the tube of the cloth C (FIG. 12). Thus, according to the above-described arrangement, it is possible to avoid a situation where the intermediate portion 1 cannot be put into the tube of the cloth, while the tapered first end 2 can be put into the tube.

The tip of the second end 3 (spherical portion 32) is rounded. According to this arrangement, in e.g. putting cotton into bag-shaped cloth, the work is performed efficiently by pushing the cotton into the bag with the tip (spherical portion 32) of the second end 3.

Though the embodiment of the present invention is described above, the present invention is not limited to this and can be varied in many ways without departing from the spirit of the present invention.

Figure 13:
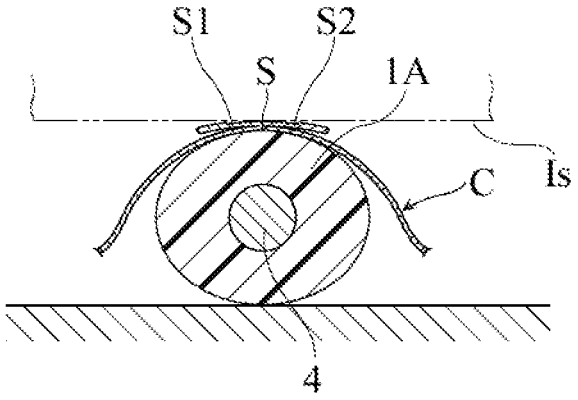
FIG. 13 is a sectional view showing a use state of a variation of the handicraft tool according to the present invention.
Figure 14:
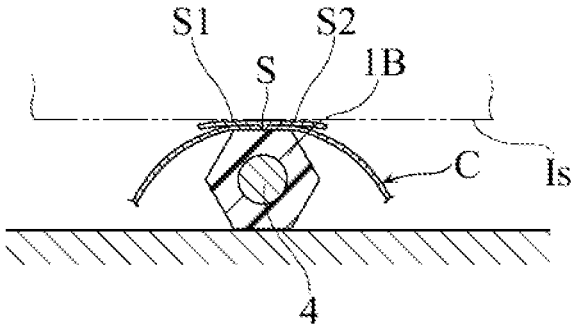
FIG. 14 is a sectional view showing a use state of another variation of the handicraft tool according to the present invention.

For instance, the intermediate portion 1 does not necessarily need to be circular in cross section but may have other shapes as long as it is elongated and has a uniform cross section. For instance, the cross section of the intermediate portion 1 may be oval as shown in FIG. 13 or polygonal as shown in FIG. 14 (hexagonal in the illustrated example). The examples shown in FIGS. 13 and 14 also provide the same advantages as that of the example described with reference to FIG. 8. Specifically, even when the oval intermediate portion 1A shown in FIG. 13 or the polygonal intermediate portion 1B shown in FIG. 14 is used in ironing the seam allowances S1 and S2, only the portions of the seam allowances S1 and S2 which are relatively close to the seam S are pressed by the flat ironing surface Is.

The invention claimed is:

1. A handicraft tool comprising:

a first end and a second end spaced apart from each other in a longitudinal direction;

an intermediate portion positioned between the first end and the second end; and a metal shaft member elongated in the longitudinal direction, wherein, the intermediate portion is in form of a bar having a cross section that is uniform along the longitudinal direction, at least a surface of the intermediate portion is made of a thermosetting elastomer, the shaft member is embedded in the intermediate portion and extends from the first end, throughout the intermediate portion and to the second end, and the first end includes a first flat surface and a second flat surface that face away from each other in a direction perpendicular to the longitudinal direction, the first flat surface and the second flat surface coming closer to each other as proceeding toward a tip of the first end.

2. The handicraft tool according to claim 1, wherein the intermediate portion is columnar.

3. The handicraft tool according to claim 1, wherein an outer circumference of the first end in a predetermined region elongated in the longitudinal direction is substantially equal to an outer circumference of the intermediate portion.

4. The handicraft tool according to claim 1, wherein the second end has a round tip.

5. The handicraft tool according to claim 2, wherein the intermediate portion has a circular cross section.

6. The handicraft tool according to claim 2, wherein the intermediate portion has an elliptic cross section.

7. The handicraft tool according to claim 2, wherein the intermediate portion has a polygonal cross section having at least one pair of parallel edges.

8. An ironing method using the handicraft tool according to claim 1, the method comprising:

placing a piece of cloth over at least the intermediate portion; and pressing the cloth onto the intermediate portion with an iron while ironing the piece of cloth.

9. The method according to claim 8, wherein a seam of the cloth is arranged to extend along the intermediate portion when the cloth is placed over the intermediate portion.

* * * * *